US008997376B2

(12) United States Patent
Carnegie et al.

(10) Patent No.: US 8,997,376 B2
(45) Date of Patent: Apr. 7, 2015

(54) PROCESS FOR DRYING MATERIAL AND DRYER FOR USE IN THE PROCESS

(75) Inventors: Roderick Howard Carnegie, Woodend (AU); Brendon Gerrard Cooper, South Yarra (AU); William John Stevens, East Melbourne (AU)

(73) Assignee: Pacific Edge Holdings Pty Ltd, Melbourne, Victoria (AU)

( * ) Notice: Subject to any disclaimer, the term of this patent is extended or adjusted under 35 U.S.C. 154(b) by 0 days.

(21) Appl. No.: 14/126,539

(22) PCT Filed: Jun. 18, 2012

(86) PCT No.: PCT/AU2012/000701

§ 371 (c)(1),
(2), (4) Date: Feb. 24, 2014

(87) PCT Pub. No.: WO2012/171078

PCT Pub. Date: Dec. 20, 2012

(65) Prior Publication Data

US 2014/0223766 A1 Aug. 14, 2014

(30) Foreign Application Priority Data

Jun. 17, 2011 (AU) ..... 2011902384
Jun. 17, 2011 (AU) ..... 2011902387

(51) Int. Cl.
*F26B 25/14* (2006.01)
*C10B 57/10* (2006.01)
(Continued)

(52) U.S. Cl.
CPC ..... *C10B 57/10* (2013.01); *F26B 17/14* (2013.01); *F26B 3/02* (2013.01); *C10L 5/10* (2013.01); *C10L 5/361* (2013.01)

(58) Field of Classification Search
CPC ..... F26B 3/00; F26B 3/02; F26B 5/00; F26B 7/00; F26B 17/12; F26B 17/14; F26B 21/00; F26B 21/08; F26B 25/14; C10B 1/00; C10B 1/02; C10B 5/00; C10B 5/02; C10L 9/00; C10L 9/08
USPC ..... 34/411, 477, 491; 48/198.3; 44/592, 44/608, 626; 201/1, 17, 29
See application file for complete search history.

(56) References Cited

U.S. PATENT DOCUMENTS 2,586,703 A * 2/1952 Odell ..... 201/16
2,843,942 A * 7/1958 Whitsel, Jr. ..... 34/370
(Continued)

FOREIGN PATENT DOCUMENTS

EP 0 382 178 * 2/1990
GB 747261 * 3/1956

OTHER PUBLICATIONS

PCT/AU2012/000701 International Search Report dated Sep. 14, 2012 (5 pages).
(Continued)

*Primary Examiner* — Steve M Gravini
(74) *Attorney, Agent, or Firm* — Brinks Gilson & Lione; G. Peter Nichols

(57) ABSTRACT

A process of drying moisture containing material having a tendency to create dust when dried, said process including the steps of providing said material in a heated chamber having a steam containing atmosphere at a temperature above the dew-point of the steam, recirculating a hot gas including a portion of the steam through said chamber in order to evaporate moisture from the material to a predetermined level of dryness.

20 Claims, 2 Drawing Sheets

(51) Int. Cl.

| | |
|---|---|
| ***F26B 17/14*** | (2006.01) |
| ***F26B 3/02*** | (2006.01) |
| ***C10L 5/10*** | (2006.01) |
| ***C10L 5/36*** | (2006.01) |

(56) References Cited

U.S. PATENT DOCUMENTS

| | | | | | |
|---|---|---|---|---|---|
| 3,518,773 | A | * | 7/1970 | Johanson | 34/468 |
| 4,285,140 | A | * | 8/1981 | van Raam et al. | 34/403 |
| 4,502,227 | A | * | 3/1985 | Janusch | 34/380 |
| 4,514,912 | A | | 5/1985 | Janusch et al. | |
| 4,526,903 | A | * | 7/1985 | Cummings | 518/704 |
| 4,725,337 | A | | 2/1988 | Greene | |
| 5,361,513 | A | * | 11/1994 | Woessner | 34/363 |
| 6,584,701 | B1 | * | 7/2003 | Brown et al. | 34/169 |
| 7,879,117 | B2 | * | 2/2011 | Hunt | 44/621 |
| 7,992,319 | B2 | * | 8/2011 | Wilson | 34/165 |
| 8,371,041 | B2 | * | 2/2013 | Bonner et al. | 34/505 |
| 8,671,586 | B2 | * | 3/2014 | Bonner et al. | 34/381 |
| 2005/0050799 | A1 | | 3/2005 | Buchanan et al. | |
| 2011/0173836 | A1 | * | 7/2011 | Orr et al. | 34/417 |

OTHER PUBLICATIONS

PCT/AU2012/000701 International Preliminary Report on Patentability dated Oct. 14, 2013 (15 pages).

* cited by examiner

PROCESS FOR DRYING MATERIAL AND DRYER FOR USE IN THE PROCESS

This application claims priority to International Application No. PCT/AU2012/000701 filed Jun. 18, 2012; Australian Patent Application No. 2011902384 filed Jun. 17, 2011; and Australian Patent Application No. 2011902387 filed Jun. 17, 2011, the entire contents of each are incorporated herein by reference.

TECHNICAL FIELD OF THE DISCLOSURE

The present disclosure relates generally to a process and a dryer for drying material prone to generating dust, particularly volatile dust. The disclosure particularly relates to a dryer for drying low rank carbonaceous material, such as brown coal, peat or lignite. The invention particularly relates to a process and a dryer for drying upgraded low rank carbonaceous material with minimum generation of dust using steam. In one form, the process produces a dried particulate material suitable for use in a subsequent briquetting procedure.

BACKGROUND ART

Low rank carbonaceous materials, such as brown coal, peat and lignite, are materials having water locked into a microporous carbonaceous structure. The water content is typically high—for example 60% or higher. This means that such raw materials have a low calorific value. Moreover, these materials have the undesirable mechanical properties of being soft, friable and of low density, meaning that they are difficult, messy and inconvenient to handle.

Prior processes for upgrading low rank carbonaceous materials (which for ease of discussion will be hereinafter collectively referred to as "brown coal") in order to remove water and increase calorific value have included "briquetting" and solar drying.

Briquetting typically involves heating the raw brown coal to remove excess water, then pressing the cooled brown coal into briquettes using a press or roll briquetting machine. However, briquetting is energy intensive due to the need for thermal energy to heat the raw brown coal.

The solar drying process involves milling of the brown coal with addition of water, then solar drying of the milled slurry in shallow ponds. This process is lengthy—particularly the solar drying step which may take up to several months—and energy intensive.

Another proposal mechanically releases water from brown coal by physically breaking up the brown coal. However, this process is inconvenient and time consuming and still requires lengthy air drying of the final product.

WO 01/54819 describes an upgrading process which comprises subjecting brown coal to shearing stresses which cause attritioning of the microporous structure of the brown coal and release of water contained in the micropores.

The shearing-attritioning process is conducted at a nip defined between two or more converging surfaces, wherein at least one of the surfaces is rollable towards the nip. The two or more converging surfaces may comprise part of a pelletising machine, such as a rotating roll type pelletising machine. The shearing-attritioning is continued until the brown coal forms a plastic mass that can be simultaneously formed into pellets, then subsequently dried. The pellet formation may be by way of forcing ("extruding") the mass through apertures in the wall of the pelleting machine. The moisture content of the formed pellets may be around 50-60%, depending on the provenance of the brown coal. Run of mine Loy Yang lignite, from Victoria, Australia typically contains around 65% moisture, which reduces to around 52% moisture after pellet formation.

All of the above upgrading processes, and particularly those involving the use of thermal energy applied through direct-drying applications, can suffer from the problem of dust generation during drying of the product, thereby requiring use of dust control steps, such as wet scrubbing or use of dust removal means including bag-house applications, which are inconvenient and expensive and can even be dangerous.

In the case of WO 01/54819, in order to accelerate drying of the upgraded brown coal pellets, hot air may be blown through the pellets. However, this can cause significant generation of dust and associated environmental pollution. Moreover, due to the pyrophoric nature of brown coal, hot air drying may also pose a significant risk of spontaneous combustion of the upgraded brown coal under some circumstances.

Another disadvantage of hot air drying is that evaporated moisture is lost. Given the current imperative to conserve water in industrial processes, it would be desirable to capture the evaporated moisture for other purposes.

The above discussion of the background to the disclosure is included to provide a context for the present disclosure. It is to be understood that such discussion does not constitute an admission that any of the material referred to was published, known or part of the common general knowledge in the art, in Australia or any other country.

It would accordingly be desirable to provide a process and an apparatus for drying material prone to generating dust, such as low rank carbonaceous material (which will hereon be collectively referred to as "brown coal" for ease of discussion), which overcomes, wholly or partly, one or more disadvantages of the prior art.

SUMMARY OF THE DISCLOSURE

In a first aspect, there is provided a process of drying moisture containing material having a tendency to create dust when dried, said process including the steps of:

- providing said material in a heated chamber having a steam containing atmosphere at a temperature above the dew-point of the steam,
- recirculating a hot gas including a portion of the steam through said chamber in order to evaporate moisture from the material to a predetermined level of dryness.

In a second aspect, there is provided a dryer for use in the above process, the dryer including:

- a chamber for receiving moisture containing material;
- a heater for heating the chamber to a temperature sufficient to evaporate moisture from the material and generate steam;
- an inlet and an outlet through which a recirculating stream of hot gas including a portion of the steam passes into and out of said chamber;
- recirculating means for recirculating the hot gas stream through the chamber.

In a third aspect there is provided a start up method for the above process of drying moisture containing material, the method including the steps:

- preheating a chamber to a predetermined temperature by indirect transfer of heat from a heated fluid,
- introducing the material into the preheated chamber to evaporate moisture therefrom and produce steam;

recirculating a portion of the steam with a hot gas stream through the chamber in order to maintain the chamber at said predetermined temperature.

The disclosure is particularly applicable to the drying of brown coal, however, it is to be understood that the process is not limited to that application. The process is particularly relevant to drying upgraded brown coal aggregates formed, for example, according to the process of WO 01/54819 the entire disclosure of which is incorporated herein by reference.

In a fourth aspect, there is provided a process for upgrading brown coal including the steps:

attritioning the brown coal to enable water to be released from the microstructure of the brown coal and thereby producing an admixture of the brown coal and released water;

forming aggregates of the admixture;

drying the aggregates to a predetermined level of dryness by:

providing said aggregates in a heated chamber having a steam containing atmosphere at a temperature above the dewpoint of the steam, and recirculating a hot gas including a portion of the steam through said chamber in order to evaporate moisture from the aggregates to the predetermined level of dryness.

In a fifth aspect, there is provided a process for upgrading brown coal including the steps:

attritioning the brown coal to enable water to be released from the microstructure of the brown coal and thereby producing an admixture of the brown coal and released water, forming aggregates of the admixture, drying the aggregates to a predetermined level of dryness under conditions sufficient to at least partially disintegrate the aggregates and form a particulate product comprising upgraded brown coal.

The upgrading process may further include the step of compacting the particulate product, such as by forming briquettes therefrom. In particular, it has been discovered by the applicant that where the particulate product contains around 10 to 20% moisture, such as around 12-15% moisture, the product is able to be briquetted without the need for a binder.

The upgrading process may further include the step of subjecting the brown coal to a conditioning step before the attritioning step. The conditioning step may include heating the brown coal to a first temperature to produce a conditioned brown coal with reduced water content. The first temperature may be in excess of 40° C. In an embodiment, the first temperature may be in excess of 45° C., such as around 50° C. In another embodiment, the first temperature may be in excess of 50° C., such as around 60° C. In another embodiment, the first temperature may be up to 70° C.

The first water content will depend on the particular provenance and characteristics of the brown coal deposit. It may vary up to about 75 wt %. In the case of brown coal deposits in Victoria, Australia, the first water content is typically about 60-65 wt %.

The second water content may vary up to about 45-55 wt %, depending on the first water content of the brown coal and the duration of the conditioning step.

The conditioning step may also include comminuting the brown coal, such as by grinding or milling, in order to break up coal lumps and result in a more homogeneous distribution of particle sizes. The brown coal may be comminuted to an average particle size of less than 10 mm, such as less than 8 mm, for example around 5 mm or lower.

The comminuting step, if included, may also contribute to the heating of the brown coal. The conditioning step may remove excess moisture from the brown coal prior to the attritioning step. The conditioning step also imparts energy into the brown coal and thereby facilitates the subsequent upgrading steps.

The conditioning step may correspond with that disclosed in applicant's copending provisional patent application AU2011902385 entitled "A process for upgrading low rank carbonaceous material", the entire disclosure of which is incorporated herein by reference.

In a sixth aspect, there is provided upgraded brown coal produced according to the process of the disclosure. The brown coal may be in particulate or compacted form.

In a seventh aspect, there is provided a process for the production of char utilising as feed material compacted, upgraded brown coal formed in accordance with the process of the disclosure.

The applicant has found that the use of steam, instead of hot air, can more efficiently produce a dried brown coal product, and significantly reduce the generation of dust and the risk of spontaneous combustion during the drying process. Without wishing to be limited to a particular mechanism, it is believed that by using steam instead of air as the drying atmosphere, the brown coal is able to be heated to a significantly higher temperature by virtue of the higher heat carrying capacity of a steam—containing atmosphere—which is related to its greater surface area. This thereby enables moisture to be driven off more rapidly. In addition, the greater humidity of the steam atmosphere compared with air reduces both dust generation and, quite importantly, the risk of spontaneous combustion of the brown coal.

In an embodiment, the chamber is at least initially heated by means of indirect transfer of heat from a heated fluid. The fluid may be oil. The oil may be provided in one or more pipes which are located inside the chamber. The temperature of the oil is high enough to evaporate moisture from the material that is subsequently introduced into the chamber and may be from about 200° C. to 300° C. This translates to an average temperature in the chamber of at least 110° C., such as at least 130° C., for example between 150 to 160° C. The pipes may be located such that, during operation, they are positioned beneath the moisture containing material.

The heated fluid may itself be heated by a hot gas. The hot gas may be hot flue gas which is generated from other industrial processes or by burning hydrocarbons contained within the carbonaceous fuel, such as brown coal which has been previously dried using the process of the disclosure. The hydrocarbons may be burnt in an afterburner to produce the hot flue gas which exits the afterburner at a temperature of 800° C. or higher. The hot gas can be used to continuously reheat the fluid after transfer of heat from the fluid to the material. The disclosure may also include means for supplying hot gas to the heater.

During the start up of the process, the heater, which may comprise a bank of pipes containing heated oil, heats the moisture containing material to a temperature above the dewpoint of steam and thereby generates a steam containing atmosphere within the chamber. In order to maintain the temperature of the atmosphere above the dewpoint, and to thereby prevent steam from condensing within the chamber, hot gas is additionally introduced into the chamber, preferably below the material such that it flows through the material. The hot gas has a temperature in excess of 100° C., preferably higher than 200° C., such as around 300° C. or higher. The hot gas again may be hot flue gas generated from the previously mentioned combustion of dried brown coal. In this manner by keeping the steam hot via introduction of the hot gas, as well as via heat provided by the heated fluid, the steam remains above its dewpoint and prevents its condensation. As previously described the hot steamy environment accelerates removal of moisture from the material.

The material may be provided to the chamber in the form of aggregates, such as brown coal pellets. The aggregates are typically provided in the chamber in a bed. The bed may be supported above the base of the chamber on a platform. The platform may be gas permeable.

Hot gas may be introduced into the chamber through an inlet underneath the bed of material. The chamber may include louvers to control the direction and/or rate of hot gas flow within the chamber. A portion of the steam which is evaporated from the material is captured in the flow of hot gas and the stream of hot gas and steam is recirculated from an is outlet to an inlet back into the chamber. In order to avoid the concentration of steam in the chamber becoming too high, and thereby reducing or stopping further evaporation of moisture, excess steam in the atmosphere may be vented from the chamber. The excess steam can be captured and condensed as water.

The relative humidity (RH) of the atmosphere in the chamber at approximately atmospheric pressure may be maintained above 25%, such as at least 30%. In one embodiment, the RH is at least 35%, such as at least 40%. In another embodiment, the RH is a minimum of 45%. The maximum RH is 100%, and may be approximately 95-98%.

In an embodiment, the process includes a step of controlling the respective proportions of steam which are recirculated in the hot gas stream and vented from the chamber. The control step may include sensing the moisture content in the atmosphere in the chamber and when the moisture content exceeds a threshold value, an appropriate portion of the atmosphere is vented from the chamber.

During operation of the process, the temperature inside the chamber may range from at least 120° C. to about 250° C. Where the hot gas is introduced to the chamber below the bed of material, the temperature inside the chamber is typically higher below the bed than above it. For example, the temperature below the material may be from 180° C.-300° C., such as around 250° C. and the temperature above the bed may be from 120 to 160° C., such as about 140° C.

The predetermined level of dryness will depend on whether any further processing of the material is required after the drying process. For example, in one embodiment the material is dried to a dryness level of approximately 35-40% water. This drying process may form a first stage of a multi stage overall drying procedure. In this example, the material exiting the first drying stage and having a moisture content of 35-40% water, may be fed to a second drying stage in which the moisture level is reduced to around 20-25% moisture. The process used in the second drying stage may be the same as the process used in the first drying stage. The second drying stage may then be followed by a third drying stage during which the moisture content is reduced even further, such as down to around 12-18%, eg 12%-15% water. The process used in the third drying stage may be different to that used in the second and first drying stages. For example, the third drying stage may comprise treatment of the partially dried brown coal with indirect heat only, in the absence of a hot gas.

In another embodiment, the first and second drying stages may be combined into a single process such that the material exiting the chamber after the drying process has a moisture content of around 25% water. That material may be fed to a further drying stage where the material is dried to around 12-15% water. The further drying stage may be conducted in a thermal processor such as a Holo-Flite® screw dryer. The screw dryer includes a single or multiple auger feed mechanism in which the shaft and flight of each auger is heated, such as by hot oil contained therein.

In a further embodiment, the drying process is a single stage procedure resulting in a dryness level of 12-15% moisture.

It is an advantageous feature of the process when it is used to dry brown coal aggregates that the brown coal aggregates may at least partially disintegrate during the drying process as moisture is removed from them. The disintegration of the aggregates occurs at least partially as an inherent result of the drying step and is not due to deliberate attritioning or other mechanical treatment of the aggregates. The disintegration is at least partially due to expansion and release of steam and other hot gases from the interior of the aggregates and at least partially due to unavoidable abrasion of the aggregates during the drying process, especially in the case where a screw dryer is used in one drying stage. Accordingly, by the end of the drying process, and/or of any further drying stages of the brown coal, the brown coal may include or comprise particulate material. The brown coal is then able to be transferred to an agglomerating device, such as a briquetting machine.

During the drying process, it is preferred that the brown coal is dried to a moisture content whereby reabsorption of atmospheric moisture by the material does not occur. In this form, the material may be non-pyrophoric.

In an embodiment, the apparatus includes dampers to regulate hot gas flow.

In an embodiment, the apparatus is configured to operate at a slight positive pressure above atmospheric pressure.

In an embodiment, the process is designed to operate in a continuous manner and in this embodiment the chamber may include means for conveying the material through the chamber. Preferably, the means is a conveyor belt, a moving bed or similar.

In an embodiment, the apparatus includes an outlet for venting a portion of the steam-containing atmosphere, which is preferably condensed and recovered. The dryer may therefore further include a means for removing the evaporated moisture from the chamber and possibly condensing it. The condensed moisture may then be recovered and provides a valuable source of water for use in other applications.

The dryer may also further include a control means for controlling the amount of steam-containing atmosphere which is recirculated to the chamber so as to ensure that the humidity in the chamber does not become excessive and impede the drying rate.

BRIEF DESCRIPTION OF DRAWINGS

Notwithstanding any other forms which may fall within the scope of the apparatus and process as set forth in the Summary, specific embodiments will now be described, by way of example only, with reference to the accompanying drawings in which.

DETAILED DESCRIPTION OF DRAWINGS

Figure 1:
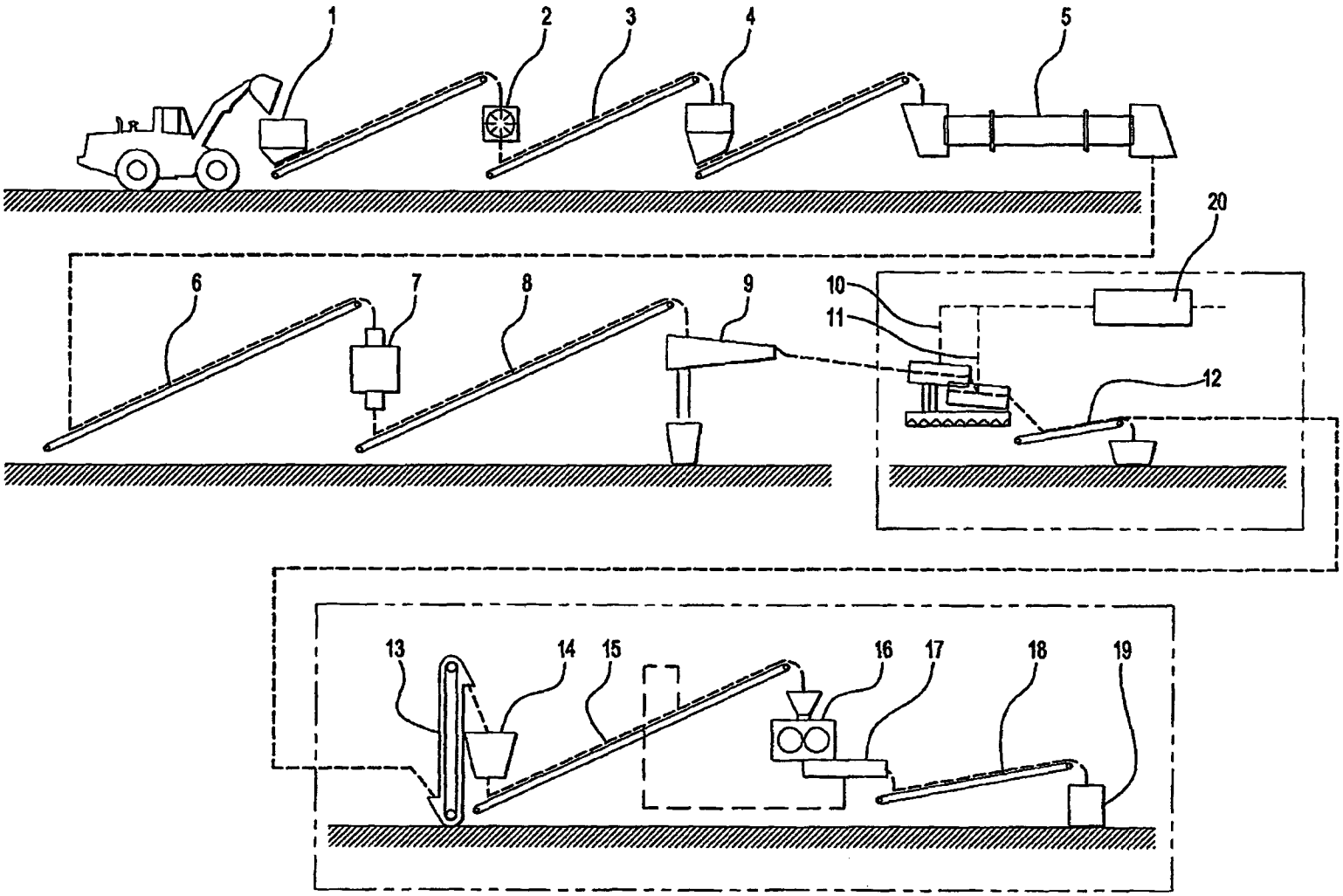
FIG. 1 is a schematic diagram illustrating the steps of a method for upgrading brown coal, which includes the drying process and apparatus of the present disclosure.

Referring to FIG. 1, raw, run of mine brown coal having a moisture content of approximately 60% is fed into the feed bin 1 and conveyed to a hammer mill 2. The hammer mill 2 comminutes the brown coal in order to break up large lumps and result in a more homogeneous distribution of particle sizes with an average particle size of around 5 mm. The hammer milled brown coal is conveyed along conveyor 3 to the milled coal storage bin 4.

The milled raw brown coal, still having approximately 60% moisture, is then conveyed to the pre dryer, 5. The hammer milled raw coal is heated in the pre dryer 5 to a temperature of approximately 50° C. The milled raw coal has an average particle size of around 5 mm. After the treatment in the pre dryer 5, the brown coal has a moisture content of around 50%.

The hammer mill and pre dryer stages together comprise a conditioning step whereby the particle size, moisture content and temperature of the brown coal may be optimised, which facilitates subsequent processing. The conditioned brown coal is then transferred from the pre dryer 5 to a feed conveyor 6 and is then transferred to an attritioning step 7. The attritioning step comprises subjecting the brown coal to shearing attritioning, which in this case is conducted in a rotating roller type pelletising mill. During the shearing attritioning step, water is released from the microstructure of the brown coal and the admixture of brown coal and released water comprises a plastic mass. The plastic mass is extruded through apertures in the wall of the pelletising mill and formed into aggregates, comprising pellets.

The brown coal pellets are transferred along conveyor 8 to a vibrating screen feeder 9. The vibrating screen feeder 9 feeds the brown coal pellets to a first drying stage, comprising a drying chamber 10. During the drying step in chamber 10, the brown pellets are subjected to a steam containing atmosphere and commence to disintegrate to form particulate coal as they pass through the drying chamber 10. The partially dried pellets have a moisture content of approximately 25% as they exit the drying chamber 10.

The pellets and particulate coal exiting drying chamber 10 enter a second drying chamber 11, comprising a Holo Flite® screw dryer having an auger feed mechanism in which the shaft and flights of each auger are heated such as a by hot oil contained therein. At the end of the second drying chamber 11, the brown coal pellets are abraded and further disintegrated into a particulate product.

Some of the steam in each of the drying chambers 10 and 11 is vented to a condenser 20 where the steam is condensed and captured for possible future use.

The particulate product exiting drying chamber 11 is conveyed along conveyor 12 to a bucket elevator 13 which feeds the particulate coal into a storage silo 14. The particulate coal is fed from the storage silo 14 along the conveyor belt 15 to a briquetter 16 which compacts the particulate, dried brown coal into briquettes. The particulate dried brown coal has approximately 12-15% moisture at which level, a binder is not required in order to form the coal briquettes. The briquettes are fed via vibrating screen feeder 17 along belt conveyor 18 and stored in a bunker 19.

The briquettes formed by the process of the invention have been found to have good mechanical strength and can be transported, such as by ship, without significant breakage or risk of spontaneous combustion.

Figure 2:
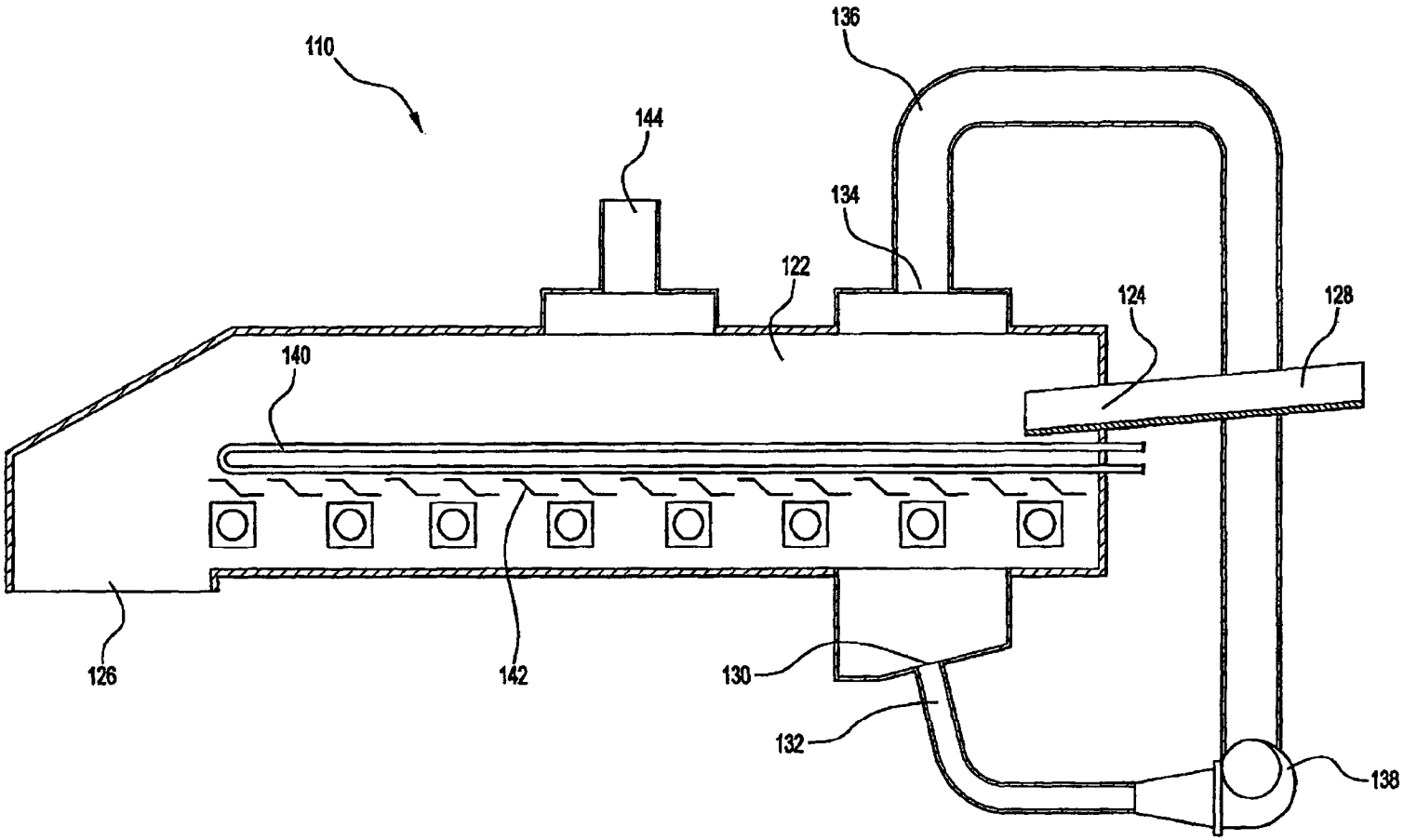
FIG. 2 is a perspective view of an embodiment of a dryer for use with an embodiment of the process of the disclosure.

FIG. 2 shows an embodiment of a dryer 110 for use with the process of the present disclosure. The dryer 110 comprises a drying chamber 122 for receiving upgraded brown coal pellets via feed inlet 124, and a dried product outlet 126 through which dried brown coal is discharged. The inlet 124 includes a vibrating feeder 128 for moving the brown coal pellets towards and into the inlet 124.

The dryer further includes a gas inlet 130 for receiving a flow of hot gas (in this case, hot flue gas) via a first conduit 132 and a gas outlet 134 from which the flow of steam exits the chamber 122 via a second conduit 136. The dryer also includes a recirculating means, comprising a fan 138, which recirculates the flow of hot gas from the gas outlet 134 back to the gas inlet 130. The recirculated hot gas is also reheated by fresh hot flue gas.

Located within the chamber 122 is a bank of heating pipes 140 which extend across the chamber 122. During process start up, the bank of heating pipes 140 receives hot oil at a temperature of about 250° C. in, order to heat the chamber 122 to the desired temperature (typically between approximately 100° C. and 250° C.). The hot oil was itself heated preferably by hot flue gas derived from or heated by other industrial processes. The flue gas has a temperature of about 300° C. or higher. Brown coal aggregates (not shown) are fed into the heated chamber 122 (via the feed inlet 124 and the vibrating feeder 128) where they are heated indirectly by the hot oil in the bank of pipes 140. The aggregates are conveyed continuously though the chamber 122 on a moving bed located above the bank of heating pipes 140. Alternatively, the aggregates may be supported directly by the bank of heating pipes 140. The aggregates move through the chamber mainly due to vibration and partly under the action of gravity. Moisture is evaporated from the aggregates and steam is generated. Evaporation of moisture causes the temperature of the oil in the tubes to decrease. The recirculating oil is therefore reheated by means of hot flue gas.

Hot flue gas is also fed directly into the chamber 122 through gas inlet 130 in order to assist in maintaining the steam above its dewpoint. A series of louvers 142 positioned beneath the hot oil pipes 140 control the rate and direction of the flow of hot gas through the bed of pellets. A portion of the steam generated by the pellets is entrained in the flow of hot gas and exits through gas outlet 134, then is recirculated back to the gas inlet 130 via conduits 136 and 132 under action of fan 138.

Where the concentration of steam in the chamber exceeds a predetermined level, the excess steam is released in a portion of the combined flow of hot flue gas and steam via vent 144. The vented steam may be condensed and captured as water.

During operation of the process, the temperature of the combined flow of hot flue gas and steam varies from about 180° C. to 300° C., preferably around 250° C. below the bed and from about 120 to 160° C., preferably around 140° C., above the bed.

The steam drying process is continued until the pellets achieved a desired level of dryness, which may vary from 40% to about 12 to 15% $H_2O$, depending on whether subsequent drying or other process steps are employed. The dried brown coal is discharged from feed outlet 126.

Accordingly, the drying process can effectively use three heating sources: indirect heating via the hot oil filled pipes, steam generated in situ by evaporation of moisture and hot flue gas fed directly into the chamber. It has been found that this combination of heat sources is particularly effective in removal of moisture from the material. In addition, virtually no dust was observed to be generated during the drying process, meaning that the need for a regular dust removal step was dramatically reduced. Moreover, the evaporated moisture was able to be captured and condensed, thereby conserving water.

EXAMPLE

Loy Yang brown coal having 62% by weight water as mined was formed into aggregates having 52% by weight water. The aggregates were subjected to a three stage drying process. Each stage was conducted at atmospheric pressure and at a temperature in the range from around 120 to 250° C. In Stage 1, the relative humidity (RH) in the chamber was approximately 48%. The aggregates exiting Stage 1 had a moisture content of around 35 wt %. In Stage 2, the drying chamber had a RH of 40% and the aggregates were dried to a moisture content of 22 wt %. In Stage 3, the drying chamber had a RH of 36% and the aggregates were dried to a moisture content of 15 wt %. By the end of Stage 3, the aggregates had partially disintegrated into particulate material. The resulting mixture of partially disintegrated aggregates and particulate material was fed to a briquetting procedure. The inherent moisture content in the mixture enabled briquetting without the need for a binder. The briquettes were found to have good mechanical strength.

In the claims which follow and in the preceding description of the disclosure, except where the context requires otherwise due to express language or necessary implication, the word "comprise" or variations such as "comprises" or "comprising" is used in an inclusive sense, i.e. to specify the presence of the stated, features but not to preclude the presence or addition of further features in various embodiments of the disclosure.

The invention claimed is:

1. A dryer for use in drying moisture containing material comprising aggregates of brown coal having a tendency to create dust when dried, whereby the process minimizes generation of the dust, the process including the steps of:

providing the material in a heated chamber having a steam containing atmosphere at a temperature above the dewpoint of the steam, recirculating a hot gas including a portion of the steam through said chamber in order to evaporate moisture from the material to a predetermined level of dryness, and controlling the relative humidity by venting excess steam from the chamber when the steam content exceeds a threshold value, wherein the chamber receives and continuously conveys the moisture containing material therethrough;

the dryer further including a heater for heating the chamber to a temperature sufficient to evaporate moisture from the material and generate steam to maintain the steam above its dewpoint;

an inlet and an outlet through which a recirculating stream of hot gas including a portion of the steam passes into and out of said chamber;

recirculating means for recirculating the hot gas stream through the chamber; and a vent which is operable to control the relative humidity in the chamber by releasing a portion of the hot gas stream from the chamber when the concentration of steam in the chamber exceeds a threshold value.

2. The dryer of claim 1 wherein the heater comprises a bank of heating pipes extending across the chamber.

3. The dryer of claim 1 wherein the chamber includes a vibrating moving bed provided above the heater and which is operable to convey material through the chamber.

4. The dryer of claim 1 further including louvers for controlling the rate and direction of the hot gas stream through the material.

5. A process for upgrading brown coal including the steps:

attritioning the brown coal to enable water to be released from the microstructure of the brown coal and thereby producing an admixture of the brown coal and released water;

forming aggregates of the admixture;

drying the aggregates to a predetermined level of dryness while minimizing generation of dust by:

providing said aggregates in a heated chamber having a steam containing atmosphere at a temperature above the dewpoint of the steam, and recirculating a hot gas including a portion of the steam through said chamber in order to evaporate moisture from the aggregates to the predetermined level of dryness; and controlling the relative humidity by venting excess steam from the chamber when the steam content exceeds a threshold value.

6. A process of claim 5, wherein the temperature inside the chamber ranges from 120 to 250° C.

7. A process of claim 5, wherein the average temperature inside the chamber is at least 110° C.

8. A process of claim 5, wherein the hot gas is a hot flue gas which is generated by burning hydrocarbons.

9. A process of claim 5, wherein the hot gas is introduced below the moisture containing material.

10. A process of claim 5, wherein the steam is at least partly generated from evaporation of moisture from the material.

11. A process of claim 5, wherein the predetermined level of dryness is 35 to 40% by weight of water.

12. A process of claim 5, wherein the predetermined level of dryness is 20 to 25% by weight of water.

13. A process of claim 5, wherein the predetermined level of dryness is 12 to 18% by weight of water.

14. A process of claim 5, comprising a multistage process.

15. A process of claim 14, wherein the final stage comprises drying with indirect heat in the absence of a circulating hot gas.

16. A process of claim 5, wherein the aggregates at least partially disintegrate during the drying process to form a mixture of partially disintegrated aggregates and particulate material.

17. A process of claim 16, including briquetting the mixture without a binder.

18. A process of claim 5, wherein the relative humidity in the chamber at atmospheric pressure is maintained above 25%.

19. A process for the production of char utilizing as feed material upgraded brown coal formed by the process of claim 5.

20. A process of drying moisture containing material comprising aggregates of brown coal having a tendency to create dust when dried, whereby said process minimises generation of said dust the process including the steps of:

preheating a chamber by indirect transfer of heat form a heated fluid;

introducing a portion of the aggregates of brown coal into the preheated chamber to evaporate moisture therefrom and produce steam;

recirculating a portion of the steam with a hot gas stream through the chamber in order to attain a temperature above the dewpoint of steam;

continuing to introduce the aggregates into the chamber having the stream containing atmosphere at a temperature above the dewpoint of the steam;

continuing to recirculate the hot gas including a portion of the steam through said chamber in order to evaporate moisture from the material to a predetermined level of dryness; and controlling the relative humidity by venting excess steam from the chamber when the steam content exceeds a threshold value.

* * * * *